US009376859B1

(12) United States Patent
DeWard et al.

(10) Patent No.: US 9,376,859 B1
(45) Date of Patent: Jun. 28, 2016

(54) TILTER ASSEMBLY FOR A WINDOW COVERING

(71) Applicant: NEWELL WINDOWFURNISHINGS, INC., High Point, NC (US)

(72) Inventors: Joshua L. DeWard, Atlanta, GA (US); Brian Bellamy Johnson, Atlanta, GA (US); Joshua Maust, Roswell, GA (US); Miguel Morales, Atlanta, GA (US)

(73) Assignee: Newell Window Furnishings, Inc., High Point, NC (US)

( * ) Notice: Subject to any disclaimer, the term of this patent is extended or adjusted under 35 U.S.C. 154(b) by 13 days.

(21) Appl. No.: 13/963,046

(22) Filed: Aug. 9, 2013

Related U.S. Application Data

(60) Provisional application No. 61/683,948, filed on Aug. 16, 2012.

(51) Int. Cl.

| | |
|---|---|
| ***E06B 9/32*** | (2006.01) |
| ***E06B 9/28*** | (2006.01) |
| *E06B 9/307* | (2006.01) |

(52) U.S. Cl.
CPC . *E06B 9/28* (2013.01); *E06B 9/307* (2013.01); *E06B 2009/285* (2013.01)

(58) Field of Classification Search
CPC ..... E06B 9/307; E06B 9/32; E06B 2009/285; E06B 9/322; E06B 9/368; E06B 9/361
USPC ..... 160/176.1 R, 177 R, 174, 168.1 R, 170
See application file for complete search history.

(56) References Cited

U.S. PATENT DOCUMENTS

| | | | | |
|---|---|---|---|---|
| 1,804,550 | A * | 5/1931 | Branch | 160/68 |
| 2,580,253 | A * | 12/1951 | Stuber et al. | 160/176.1 R |
| 2,580,479 | A * | 1/1952 | Stogran | 160/176.1 R |
| 2,648,472 | A | 8/1953 | Gallagher et al. | |
| 3,357,270 | A | 12/1967 | Spangenberg | |

(Continued)

FOREIGN PATENT DOCUMENTS

| | | |
|---|---|---|
| CN | 2171001 Y | 7/1994 |
| CN | 2187219 Y | 1/1995 |

(Continued)

OTHER PUBLICATIONS

Mechanical Mania "Types of Gears". 2011. <http://mechanicalmania.blogspot.com/2011/07/types-of-gear.html> Accessed Oct. 23, 2014.*

(Continued)

*Primary Examiner* — Katherine Mitchell
*Assistant Examiner* — Johnnie A Shablack
(74) *Attorney, Agent, or Firm* — Sutherland Asbill & Brennan LLP

(57) ABSTRACT

A window covering comprises a head rail and slats that are suspended from the head rail and have a plurality of edges that define a front plane. A tilter assembly is operatively connected to the slats for tilting the slats and comprises a wand shaft operatively connected to a worm gear. A drive gear operatively connected to a tilt shaft, and at least one idler gear connects the worm gear to the drive gear. The axis of rotation of the wand shaft is disposed at an angle relative to the plane to space a wand controller from the front plane. The wand shaft may include a wand connector that is releasably connected to the tilter assembly.

27 Claims, 17 Drawing Sheets

(56) References Cited

U.S. PATENT DOCUMENTS

| | | | | | |
|---|---|---|---|---|---|
| 3,425,479 | A | * | 2/1969 | Abate et al. | 160/176.1 R |
| 3,463,219 | A | * | 8/1969 | Osterholz | 160/172 R |
| 3,630,264 | A | * | 12/1971 | Debs et al. | 160/177 R |
| 3,653,777 | A | * | 4/1972 | Bross | 401/110 |
| 3,921,695 | A | * | 11/1975 | Debs | 160/176.1 R |
| 4,245,687 | A | * | 1/1981 | Vecchiarelli | 160/177 R |
| 4,274,469 | A | | 6/1981 | Kuyper et al. | |
| 4,286,479 | A | | 9/1981 | Baumann et al. | |
| 4,386,644 | A | | 6/1983 | Debs | |
| 4,406,319 | A | * | 9/1983 | McNiel et al. | 160/177 R |
| 4,408,954 | A | * | 10/1983 | Earle | 416/9 |
| 4,522,245 | A | * | 6/1985 | Anderson | 160/177 R |
| 4,531,884 | A | * | 7/1985 | Russell | 414/729 |
| 4,541,468 | A | * | 9/1985 | Anderson | 160/177 R |
| 4,593,218 | A | * | 6/1986 | Streeter | 310/103 |
| 4,671,130 | A | | 6/1987 | Byers | |
| 4,676,292 | A | * | 6/1987 | Valle et al. | 160/176.1 R |
| 4,848,435 | A | * | 7/1989 | Helver | 160/176.1 R |
| 4,949,926 | A | | 8/1990 | Liu | |
| 5,002,113 | A | | 3/1991 | Georgopoulos | |
| 5,031,681 | A | | 7/1991 | Dodich | |
| 5,038,237 | A | * | 8/1991 | Kim | 360/96.51 |
| 5,074,349 | A | | 12/1991 | Yannazzone | |
| 5,092,387 | A | | 3/1992 | King et al. | |
| 5,136,944 | A | * | 8/1992 | Gustafson et al. | 101/228 |
| 5,139,072 | A | * | 8/1992 | Marocco | 160/176.1 R |
| 5,143,135 | A | | 9/1992 | Kuhar | |
| 5,165,739 | A | | 11/1992 | Liu | |
| 5,238,043 | A | * | 8/1993 | Woodring et al. | 160/175 |
| 5,293,921 | A | * | 3/1994 | Marocco | 160/176.1 R |
| 5,396,945 | A | * | 3/1995 | Meyer | 160/177 R |
| 5,465,779 | A | * | 11/1995 | Rozon | 160/168.1 V |
| 5,472,035 | A | * | 12/1995 | Biba et al. | 160/168.1 R |
| 5,501,116 | A | * | 3/1996 | Weng | 74/89.14 |
| 5,522,444 | A | | 6/1996 | Liu | |
| 5,538,066 | A | | 7/1996 | Liu | |
| 5,538,068 | A | | 7/1996 | Liu | |
| 5,553,649 | A | * | 9/1996 | Chisaka et al. | 160/168.1 R |
| 5,573,052 | A | | 11/1996 | Liu | |
| 5,603,371 | A | * | 2/1997 | Gregg | 160/176.1 P |
| 5,636,677 | A | | 6/1997 | Liu | |
| 5,680,892 | A | | 10/1997 | Liu | |
| 5,707,308 | A | | 1/1998 | Liu | |
| 5,749,405 | A | * | 5/1998 | Huang | 160/168.1 R |
| 5,845,695 | A | * | 12/1998 | Cadorette et al. | 160/173 V |
| 5,850,863 | A | * | 12/1998 | Huang | 160/168.1 R |
| 6,044,889 | A | | 4/2000 | LIU | |
| 6,079,306 | A | | 6/2000 | Liu | |
| 6,095,228 | A | | 8/2000 | Liu | |
| 6,173,825 | B1 | | 1/2001 | Liu | |
| 6,176,290 | B1 | * | 1/2001 | Hsu | 160/177 R |
| D438,045 | S | | 2/2001 | Liu | |
| 6,196,293 | B1 | * | 3/2001 | Lee | 160/168.1 V |
| RE37,143 | E | | 4/2001 | Liu | |
| 6,257,305 | B1 | * | 7/2001 | Mullet et al. | 160/310 |
| 6,308,764 | B1 | * | 10/2001 | Lin | 160/177 R |
| 6,321,820 | B1 | | 11/2001 | Liu | |
| 6,325,133 | B1 | * | 12/2001 | Lin | 160/177 R |
| 6,357,508 | B1 | * | 3/2002 | Tronsgard et al. | 160/115 |
| 6,425,432 | B1 | * | 7/2002 | Gross et al. | 160/176.1 R |
| 6,491,085 | B1 | * | 12/2002 | Anthony et al. | 160/168.1 V |
| 6,527,034 | B1 | | 3/2003 | Liu | |
| 6,561,254 | B1 | | 5/2003 | Liu | |
| 6,601,636 | B1 | | 8/2003 | Liu | |
| 6,619,366 | B2 | * | 9/2003 | Ciuca | 160/176.1 R |
| 6,736,039 | B2 | | 5/2004 | Yang et al. | |
| 6,739,373 | B1 | | 5/2004 | Liu et al. | |
| 6,745,812 | B1 | | 6/2004 | Liu et al. | |
| 6,786,270 | B2 | * | 9/2004 | Wen et al. | 160/170 |
| 6,805,186 | B1 | * | 10/2004 | Nien | 160/177 R |
| 6,910,516 | B2 | * | 6/2005 | Huang | 160/170 |
| 6,973,952 | B2 | * | 12/2005 | Nien | 160/170 |
| 7,178,577 | B2 | | 2/2007 | Liu | |
| 7,204,292 | B2 | * | 4/2007 | Nien | 160/168.1 R |
| 7,258,297 | B2 | | 8/2007 | Liu | |
| 7,287,570 | B2 | * | 10/2007 | Strand | 160/171 |
| 7,311,133 | B2 | * | 12/2007 | Anderson et al. | 160/170 |
| D569,157 | S | | 5/2008 | Liu | |
| 7,387,150 | B2 | | 6/2008 | Liu | |
| 7,562,600 | B2 | | 7/2009 | Liu | |
| 7,878,230 | B2 | * | 2/2011 | Daus et al. | 160/9 |
| 7,934,440 | B2 | * | 5/2011 | Samudosky | 81/57.29 |
| 8,910,696 | B2 | * | 12/2014 | Wen et al. | 160/177 R |
| 2002/0174961 | A1 | * | 11/2002 | Anderson et al. | 160/178.1 R |
| 2003/0041979 | A1 | | 3/2003 | Liu | |
| 2003/0111783 | A1 | | 6/2003 | Yang et al. | |
| 2003/0173037 | A1 | | 9/2003 | Liu | |
| 2004/0103995 | A1 | * | 6/2004 | Nien | 160/170 |
| 2006/0000562 | A1 | | 1/2006 | Liu | |
| 2006/0070474 | A1 | | 4/2006 | Liu | |
| 2006/0124797 | A1 | | 6/2006 | Liu | |
| 2007/0056699 | A1 | | 3/2007 | Liu | |
| 2007/0251653 | A1 | | 11/2007 | Liu | |
| 2008/0023157 | A1 | * | 1/2008 | Ganzi | 160/176.1 R |
| 2008/0099161 | A1 | | 5/2008 | Liu | |
| 2008/0163989 | A1 | * | 7/2008 | Sales et al. | 160/310 |
| 2008/0202702 | A1 | | 8/2008 | Liu | |
| 2011/0100564 | A1 | * | 5/2011 | McTaggert | 160/168.1 R |
| 2012/0298317 | A1 | * | 11/2012 | Huang | 160/170 |
| 2013/0068406 | A1 | * | 3/2013 | Lin | 160/331 |
| 2013/0220561 | A1 | * | 8/2013 | Yu et al. | 160/340 |
| 2014/0290876 | A1 | * | 10/2014 | Chen | 160/170 |

FOREIGN PATENT DOCUMENTS

| | | |
|---|---|---|
| CN | 263007 | 3/1995 |
| TW | M358880 U | 6/2009 |
| TW | M417106 U | 12/2011 |
| TW | M421071 U | 1/2012 |

OTHER PUBLICATIONS

Bhandari, "Gear Trains," Design of Machine Elements, 2010, Tata McGraw-Hill Education, p. 656.*

* cited by examiner

TILTER ASSEMBLY FOR A WINDOW COVERING

This application claims benefit of priority under 35 U.S.C. §119(e) to the filing date of U.S. Provisional Application No. 61/683,948, as filed on Aug. 16, 2012, which is incorporated herein by reference in its entirety.

BACKGROUND

Horizontal blinds typically utilize a tilting mechanism that enables a user to selectively adjust the angle of the blind slats. There are two typical arrangements for a tilter mechanism. The first is a cord-controlled tilter assembly comprising two cords, or a corded loop, operated by the user pulling one cord or the other. The second is a wand-controlled tilter assembly operated by the rotational movement of a wand tilter in a first direction and a second direction. The cords or wands are in mechanical communication with tilter assemblies that are connected to the blind slats by tilt cords. The tilt assemblies are positioned generally within the head rail of a blind. The head rail may also house operating components that control additional blind operations such as the raising and lowering of the slats.

SUMMARY OF THE INVENTION

In some embodiments a window covering comprises a head rail. A plurality of slats are suspended from the head rail and have a plurality of edges that define a plane. A tilter assembly is operatively connected to the slats for tilting the slats. The tilter assembly comprises a wand shaft operatively connected to a worm gear and having an axis of rotation. A drive gear is operatively connected to a tilt shaft. At least one idler gear connects the worm gear to the drive gear.

In some embodiments, a window covering comprises a head rail and a plurality of slats defining a front plane. A tilter assembly is supported by the head rail and is operatively connected to the slats for tilting the slats. The tilter assembly comprises a drive gear coupled to a tilt shaft and a worm gear operatively meshing with the drive gear. A wand connector is releasably connected to the worm gear for rotating the drive gear, and defines a connection point. A control wand is connected to the wand connector at the connection point.

In some embodiments a tilter assembly for a window covering having a head rail and a plurality of slats defining a front plane comprises a wand connector releasably connected to a worm gear. The wand connector further comprises a connection point opposite to the worm gear for receiving a control wand. A drive gear is operatively connected to a tilt shaft and operatively engages the worm gear.

The axis of rotation of the wand shaft may be disposed at an angle relative to the plane of at least 20 degrees. The angle may be in the range of approximately 20 degrees and approximately 35 degrees. The wand shaft may comprise a wand connector coupled to the worm gear. A control wand may be connected to the wand connector at the connection point, the wand connector may be disposed at an angle relative to the plane such that the connection point is spaced from the plane at least 0.25 inches. A gear ratio between the worm gear and the drive gear may be in the range of between approximately 5:1 to approximately 15:1. The drive gear may comprise an aperture that receives the tilt shaft. The tilt shaft may support at least one tilt drum that is connected to the plurality of slats by a tilt cord. The tilt drum may include a keyed aperture that receives the tilt shaft. The head rail may have a height and the tilt shaft may be located in the top 25% of the height of the head rail. The head rail may comprise a front wall, a bottom wall, and a back wall where the worm gear is positioned most proximate the front wall relative to the idler gear and the drive gear, and where the idler gear is positioned second most proximate the front wall relative to the drive gear and the worm gear. The head rail may comprise a front wall, a bottom wall, and a back wall where the distance between the bottom wall and the axis of the drive gear is greater than the distance between the bottom wall and the axis of the idler gear. The wand shaft may exit the head rail adjacent the front wall and the axis of rotation of the drive gear may be located midway between the front wall and the back wall. The axis of rotation of the tilt shaft may be in the upper half of the height of the head rail. The internal space of the head rail in cross-section may define four quadrants in a cross-sectional plane, the wand shaft may exit the head rail in a first quadrant and the axis of the drive gear may be in a second quadrant where the second quadrant is diametrically opposed to the first quadrant. The first quadrant may be located adjacent the intersection of the bottom wall and the front wall and the second quadrant may be located adjacent the back wall. The head rail may comprise a front wall, a bottom wall, and a back wall where the wand shaft exits the head rail at a point adjacent the intersection of the bottom wall and the front wall where the axis of rotation of the wand shaft is disposed such that the axis of rotation of the idler gear is positioned between the worm gear and the back wall and the axis of rotation of the drive gear is positioned between the axis of rotation of the idler gear and the back wall. A worm gear may be connected to the wand connector and an idler gear may connect the worm gear and the drive gear where the idler gear, the worm gear and the drive gear are retained in a casing. The casing may be snap-fit into the head rail. The wand connector may extend through an aperture in a front wall of the head rail. The tilt shaft may engage the drive gear. A keyed connection may be formed on the worm gear where the keyed connection receives the wand connector. A locking member may couple the wand connector to the worm gear when the wand connector is engaged with the keyed connection. The various aspects of the invention as described herein may be arranged in various combinations.

A method of making and using a window covering comprises mounting a tilter assembly comprising a gear in a head rail such that a tilt shaft is positioned near a top of the head rail; mounting a second operating system in the head rail between the shaft and a bottom of the head rail; packaging the head rail in a package where a wand connector is separate from the tilter assembly, the wand connector being releasably engageable with the gear. In the method the second operating system may comprise a lift system. In the method a control wand may be packaged in the package where the control wand may be releasably engageable with the wand connector.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures. It will be understood that these terms are intended to encompass different orientations of the device in addition to the orientation depicted in the figures. Any dimensions, sizes, ratios, or proportions described herein or provided in any of the figures provided herein are provided for exemplary purposes only and are not intended to be limiting. Any other dimensions, sizes, ratios, or proportions may be utilized without departing from the spirit of the inventions described herein.

Figure 1:
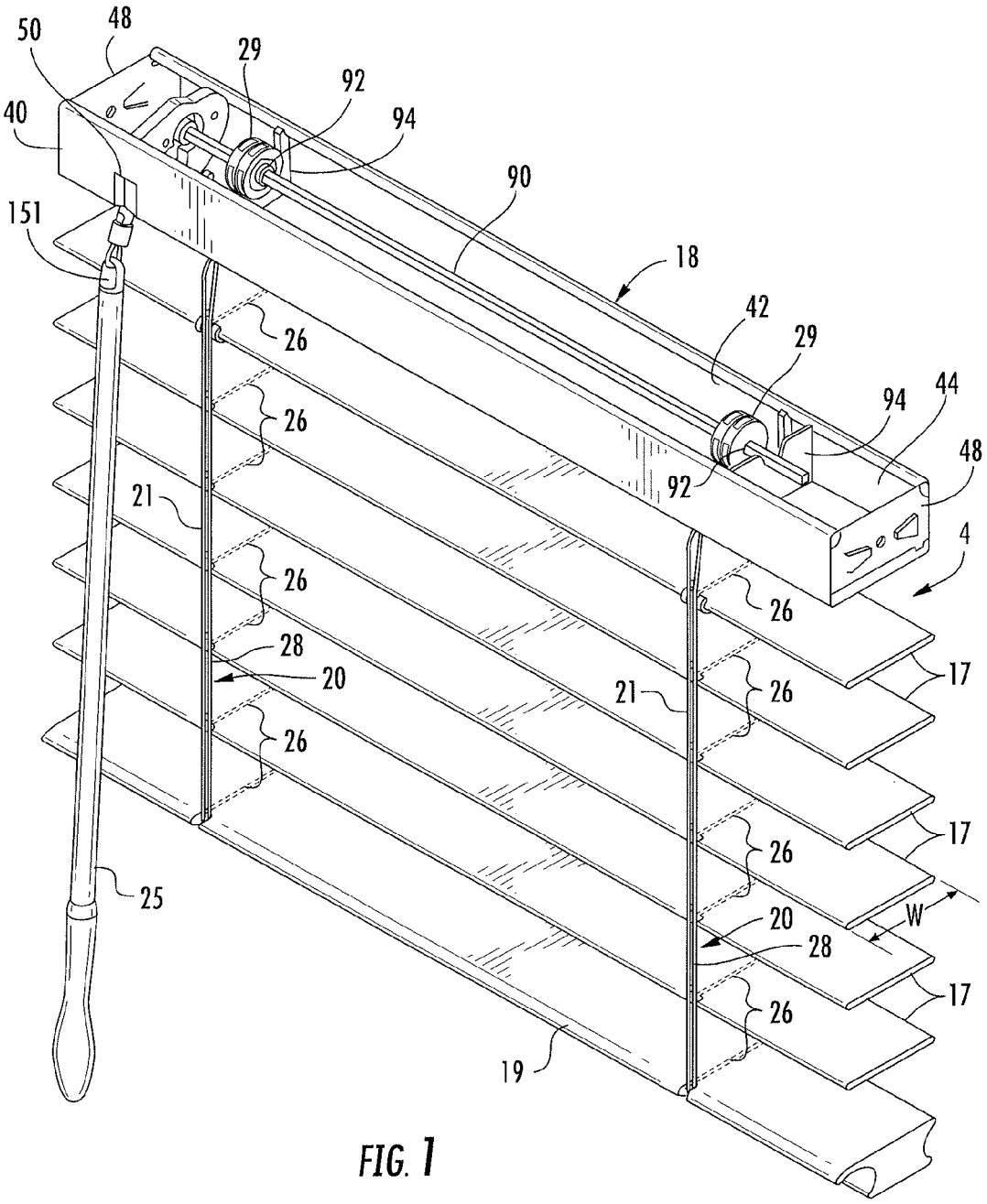
FIG. 1 is a perspective view of an embodiment of a window covering using the tilter assembly of the invention.
Figure 2:
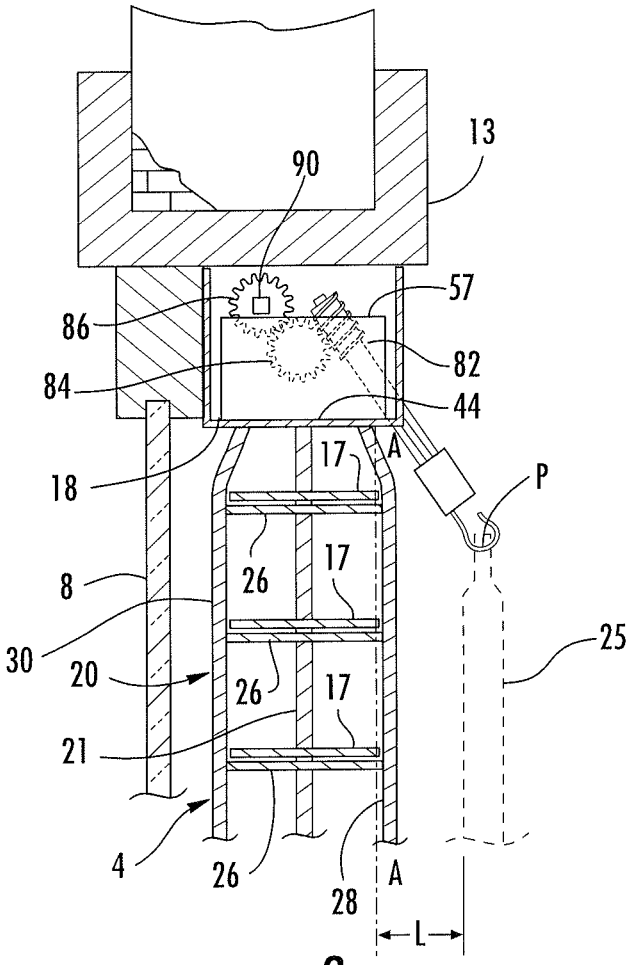
FIG. 2 is a partial section view of an embodiment of a window covering using the tilter assembly of the invention.

Referring to FIGS. 1 and 2 embodiments of a window covering 1 are shown comprising a head rail 18 from which a panel 4 is suspended. The panel may comprise a slatted blind comprised of a plurality of slats 17. Accordingly, it is appreciated that the term "panel" 4 as utilized herein can refer to, in one embodiment, and include a window covering that has a plurality of slats 17. The head rail 18 may be constructed of wood, steel, aluminum or other rigid material and may be solid or have an interior space. It is appreciated that, in some embodiments, the term "head rail" need not be limited to a traditional head rail structure and may include any structure, component or components from which a shade may be suspended or supported and which may include the operating system. The head rail 18 may be mounted to a window frame or other architectural feature 13 by brackets or other mounting mechanism to cover the window or other opening 8 (FIG. 2). The panel 4 has a top edge, such as the uppermost slat 17, that is located adjacent to the head rail 18 and a bottom edge remote from the head rail 2 that may terminate in a bottom rail 19 or in proximity thereto.

The shade panel 4 may be supported by lift cords 21 that are connected to or near the bottom edge of the panel 4 or to the bottom rail 19. The lift cords 21 may be retracted toward the head rail 18 to raise the shade or extended way from the head rail to lower the shade. The lift cords 21 may be operatively connected to a lift system that may be used to raise and lower the shade panel. In one type of window covering, known as a privacy panel, each lift cord extends down the outside of one side of the panel, around the bottom of the panel and up the outside of the other side of the panel, as shown in FIG. 1. In another embodiment of a privacy panel the lift cord comprises a first lift cord section that extends down the outside of one side of the panel to the bottom of the panel and a second lift cord section that extends down the outside of the other side of the panel to the bottom of the panel. The lift cord sections may be connected to one another, to the bottom of the panel or to bottom rail, or both. In another type of window covering the lift cords 21 extend through apertures formed in the shade panel, such as through apertures in slats 17, as shown in FIG. 2.

For a slatted blind, the slats 17 of the shade panel 4 are also supported by a tilt cord 20 that functions to tilt the slats 17 between open positions where the slats 17 are spaced from one another and closed positions where the slats 17 are disposed in an abutting, overlapping manner. The tilt cord 20 may comprise a ladder cord as shown that supports the individual slats 17 where manipulation of the ladder cord results in the tilting of the slats 17 between an open position, closed positions and any intermediate position. The tilt cord 20 may be controlled by a user control 25 such as a control wand that is manipulated by the user to adjust the opening and closing of the slats. Each tilt cord 20 may comprise a ladder cord that has a plurality of rungs 26 that are connected to and supported at each end by vertical support cords 28 and 30. A slat 17 rests on top of or is otherwise supported by each rung 26. A drum 29 or other control device may be operably connected to and rotated by a user using control 25 such that the front vertical support cord 28 may be raised or lowered while the back vertical support cord 30 is simultaneously lowered or raised, respectively, to tilt the rungs 26 and the slats 17. Typically, the slats 17 are supported by two or more tilt cords 20 and two or more lift cords 21 depending upon the width of the window covering. It is appreciated that the number of tilt cords 20 and the number of lift cords 21 need not be the same, although in some embodiments they can be. While specific embodiments of a window covering are disclosed, the window covering may have a wide variety of constructions and configurations.

In some instances, such as for products having wider slat widths W (FIG. 1), the wand 25 and/or the assembly that interfaces the wand 25 with the tilter assembly, can interfere with the slats 17. For example, without the improvements described in view of various embodiments herein, the wand 25 and/or other components of the tilter assembly may otherwise exit the head rail 18 at an angle that interferes with the slats due to the conventional design of a tilter assembly and the limits imposed by the size constraints within a head rail 18. Interference may cause inconvenience during operation of the blind and/or damage during packaging and/or shipping of the window covering.

Accordingly, embodiments of the invention described herein solve the problem of wand interference with the slats by providing a new and improved tilter assembly, having reconfigured and improved components that allow for improved fitment within the head rail 18 and advantageously avoid interference with any of the slats 17 or other aspect of the shade panel 4. One improvement achieved by embodiments described herein is the ability to move the wand connection point forward of the front edge of the slats by positioning the wand connector at an increased angle relative to a plane defined by the front edge of the blind slats, as shown in the attached drawings. Furthermore, embodiments of the invention described herein reposition the axis of the tilt shaft and tilt drums 29 at or near the upper limit of the head rail, which advantageously increases available space within the length of the head rail and allows room for lift system components to be placed below the tilt shaft. One or more idler gears or geared combinations can be used to accommodate the position of the tilt shaft and the wand connection point while ensuring that the gears fit inside the constraints of the head rail and that the wand can exit the head rail at an angle desirable to clear larger slats, as will be explained. Conventional tilter systems typically constrain the amount of useable space along the length of the head rail and thus create undesirable size constraints on other operating system components to fit within the head rail. Moreover, as reducing the size of the head rail continues to be a driving factor for window covering designers, such as for aesthetic reasons, increasing the amount of useable space within a head rail is desirable.

Moreover, in many instances, the package size for blinds can be impacted by the distance that the wand connector protrudes from the head rail. For example, when a blind is in a package, the wand connector may extend beyond the confines of the remaining blind components (e.g., slats, bottom rail, head rail, etc.). In other words when the blind is in the completely collapsed storage position where the slats are stacked on top of one another and the stack of slats is positioned adjacent the head rail the wand connector may extend beyond the profile of the head rail and slats. The protruding wand connector may make packaging more difficult and expensive. Accordingly, in one embodiment as also described herein, the tilter assembly may optionally include a wand connector that is removably connected to the tilter assembly. The wand connector may be removed from the tilter assembly for packaging and shipping and may be easily connected to the tilter assembly by the user before use. Because the wand connector is not connected to the tilter assembly during packaging and shipping, a smaller sized package may be used and the possibility that the wand connector may cause damage to other components of the blind or be damaged itself during packaging or shipping is minimized.

Figure 3:
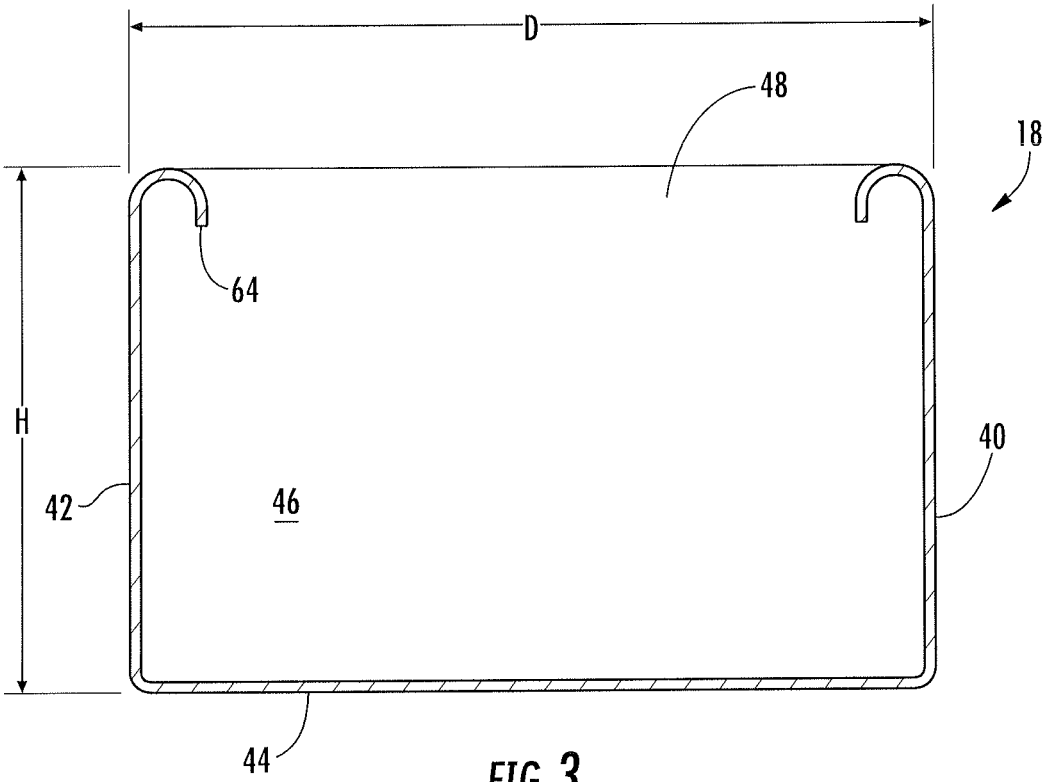
FIG. 3 is a section view of an embodiment of a head rail usable in the window covering of the invention.

A cross section of an embodiment of a head rail 18 is shown in FIG. 3 that illustrates an exemplary profile of a head rail which houses at least portions of the operating components of the blind. Many head rails in use today are generally U-shaped, having an open top side, a front wall 40, back wall 42 and a bottom wall 44 connecting the front wall 40 and back wall 42 to define an interior chamber 46 for retaining the operating systems of the blind. A pair of end walls 48 may close the ends of the chamber 46. In a typical arrangement of a window covering the head rail 18 extends generally the width of the blind and the blind slats 17 are suspended from the head rail 18 such that the slats 17 extend generally horizontally below the head rail. Typically, the slats 17 are supported on lift cords 21 and/or tilt cords 20 that are suspended from and supported by operating components stored in the head rail 18. In some embodiments the head rail may be approximately 2-2.5 inches deep D and approximately 1.5 inches high H such that the interior chamber 46 has a relatively small cross-sectional area. The head rail 18 and slats 17 extend for a desired width and may be on the order of approximately 1 foot wide to approximately 10 feet wide or larger and may be sized in a wide variety of intermediate sizes. Typically, the blind is sized to correspond to the size of the architectural feature with which the blind is used. It is to be appreciated that the dimensions and proportions described herein are provided for exemplary purposes only and are not intended to be limiting.

The cross-section illustrated in FIG. 3 is shown to illustrate the size constraints of an example head rail. The tilter assembly of the invention is designed to fit generally within such size constraints (though, in other embodiments the head rail and thus the tilter assembly may be larger or smaller or have different proportional constraints). Moreover the head rail may have different configurations from that shown. For example, the top of the head rail may closed by a top wall, the walls may have different shapes from those shown, other walls in addition to or instead of the top wall may be removed such that the head rail has a C-shape or L-shape. While in some embodiments the head rail is made of metal, the head rail may be made of a variety of materials and by any suitable process.

Figure 4:
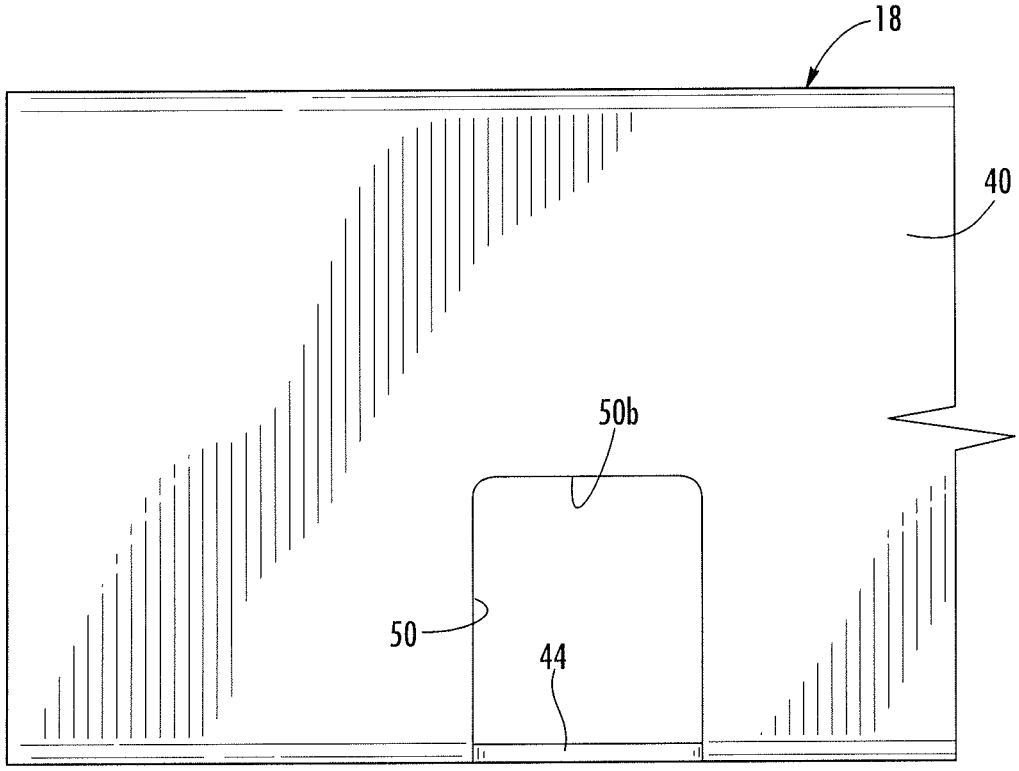
FIG. 4 is a detailed front view of an embodiment of a head rail usable in the window covering of the invention.
Figure 5:
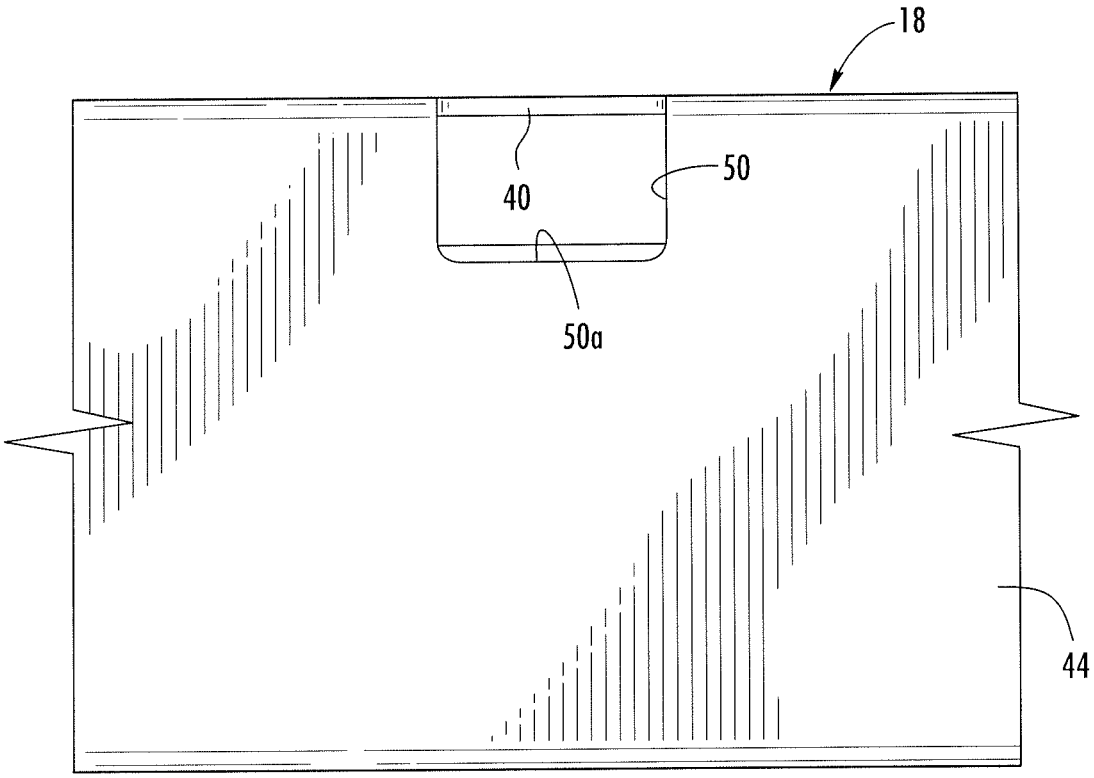
FIG. 5 is a detailed bottom view of the embodiment of the head rail of FIG. 4

FIGS. 4 and 5 show details of an aperture 50 formed in the head rail 18. The aperture 50 receives the tilter assembly and allows the wand connector to extend through the head rail 18 such that the tilter assembly may be located in the head rail with the wand connector extending through aperture 50 where it may be accessed by a user. According to one embodiment, the aperture 50 is arranged such that a first portion **50*a* of aperture 50 extends into the bottom wall 44 and a second portion 50*b* of aperture 50 extends into the front wall 40. In one embodiment the aperture 50 is punched from the head rail 18; however, the aperture may be formed by any suitable process. In existing slatted blinds, the tilter assembly is arranged such that the wand or wand connector extends primarily in a downward direction substantially perpendicularly from the bottom wall of the head rail. As a result, in existing blinds the wand connector, and often the wand, is positioned such that it interferes with the front edges of the slats (especially the uppermost slats) during operation of the window covering and during packaging and shipping. The improvements according to the embodiments described herein provide for the unique positioning of the wand connector to extend at an increased angle away from the head rail 18 and slats 17 and having at least a portion thereof extending through the front wall 40 of the head rail 18, such as through portion 50***b* of aperture 50 such that the wand connector and wand do not interfere with the slats. With reference to the figures, it is appreciated that in other embodiments, an aperture may be created entirely through the front wall 40 or entirely through the bottom wall 44 while still achieving the benefits of the features described herein.

Figure 6:
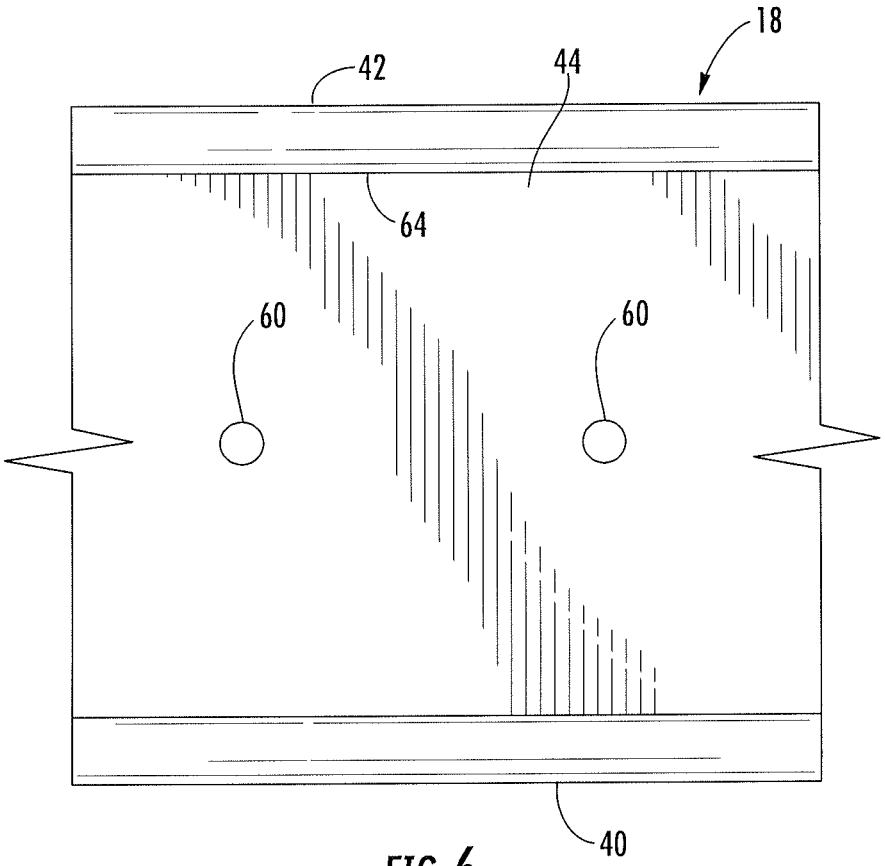
FIG. 6 is a detailed top view of the embodiment of the head rail of FIG. 4.

FIG. 6 shows a top view of an example head rail 18 such as the U-shaped head rail of FIG. 3. In one embodiment mounting holes 60 are provided in bottom wall 44 that allow a tilter assembly to be mounted to the bottom wall 44 of the head rail 18 (such as by friction fit, clips, snaps, rivets, screws, or any other mounting feature). The tilter assembly may include protruding features or lugs that extend through mounting holes to assist in securing the tilter assembly to the head rail. The shape and orientation of these holes are provided for illustrative purposes only, and any other shape, size, or configuration of mounting holes 60 may be used. Moreover, while the head rail is shown with female connectors that mate with mating male connectors on the tilter assembly, the head rail may be formed with male connectors that mate with female connectors formed on the tilter assembly. Moreover, separate mounting mechanisms may be provided that are fixed to the head rail and the tilter assembly. Other connection mechanisms for securing the tilter assembly in the head rail may be used.

Figure 10:
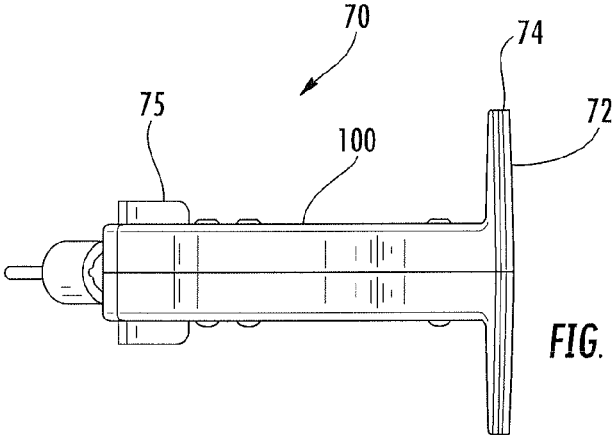
FIG. 10 is a top view of the tilter assembly of FIG. 8.
Figure 8:
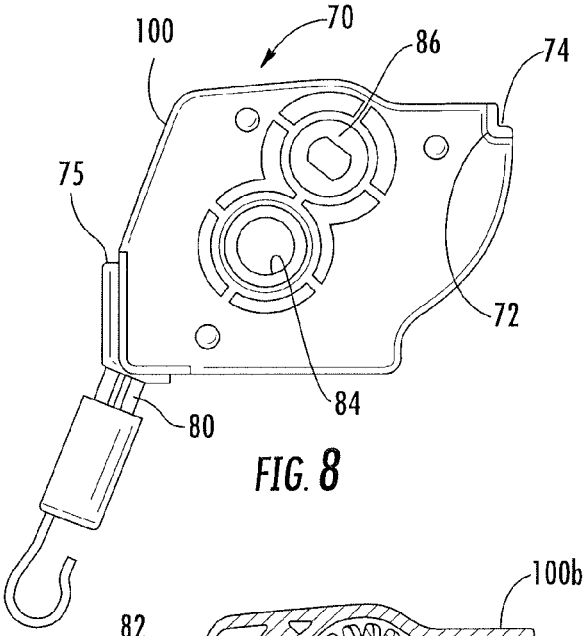
FIG. 8 is a side view of an embodiment of the tilter assembly of the invention.
Figure 9:
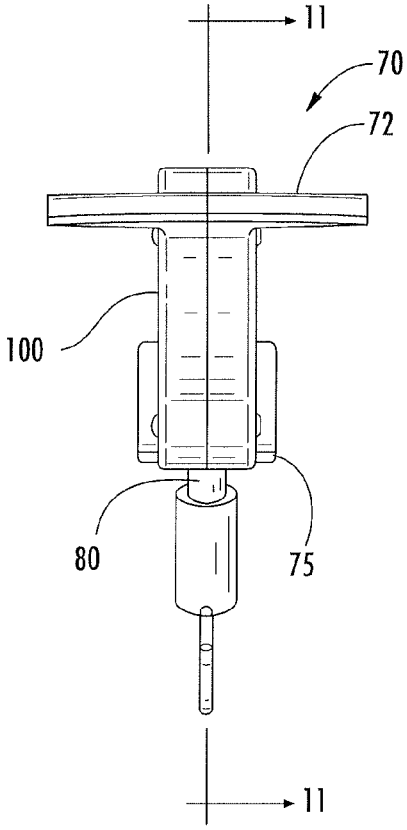
FIG. 9 is a back view of the tilter assembly of FIG. 8.

Another embodiment of a connection mechanism is shown in FIGS. 8, 9 and 10 where the back of the casing 100 for the tilter assembly 70 is provided with a flange 72 that is positioned to fit under a back lip 64 formed on the back wall 42 of head rail 18 (FIG. 3). The flange 72 may be formed with a detent 74 for receiving the lip 64. The flange 72 may extend beyond the sides of the casing 100 to form extending arms that provide additional surface area for connecting to the back lip 64 to stabilize the relatively narrow tilter assembly 70. The front of the casing of the tilter assembly 70 is formed with a protruding flange 75 that surrounds or substantially surrounds the connection point for the wand connector 80. The flange 75 is dimensioned and shaped to fit snugly in aperture 50. In this arrangement a snap-fit connection is provided where the flange 75 may be located in aperture 50 and the back of the tilter assembly 70 may be rotated downward until the flange 72 is forced under the lip 64 on head rail 18. The head rail 18 and casing may be slightly elastically deformable to allow the snap-fit connection to be made. The detent feature 74 may be used to secure the tilter assembly within the head rail 18 in combination with any of a number of securing features optionally provided proximate the bottom side of the body to interface with the bottom wall of the head rail.

Figure 7:
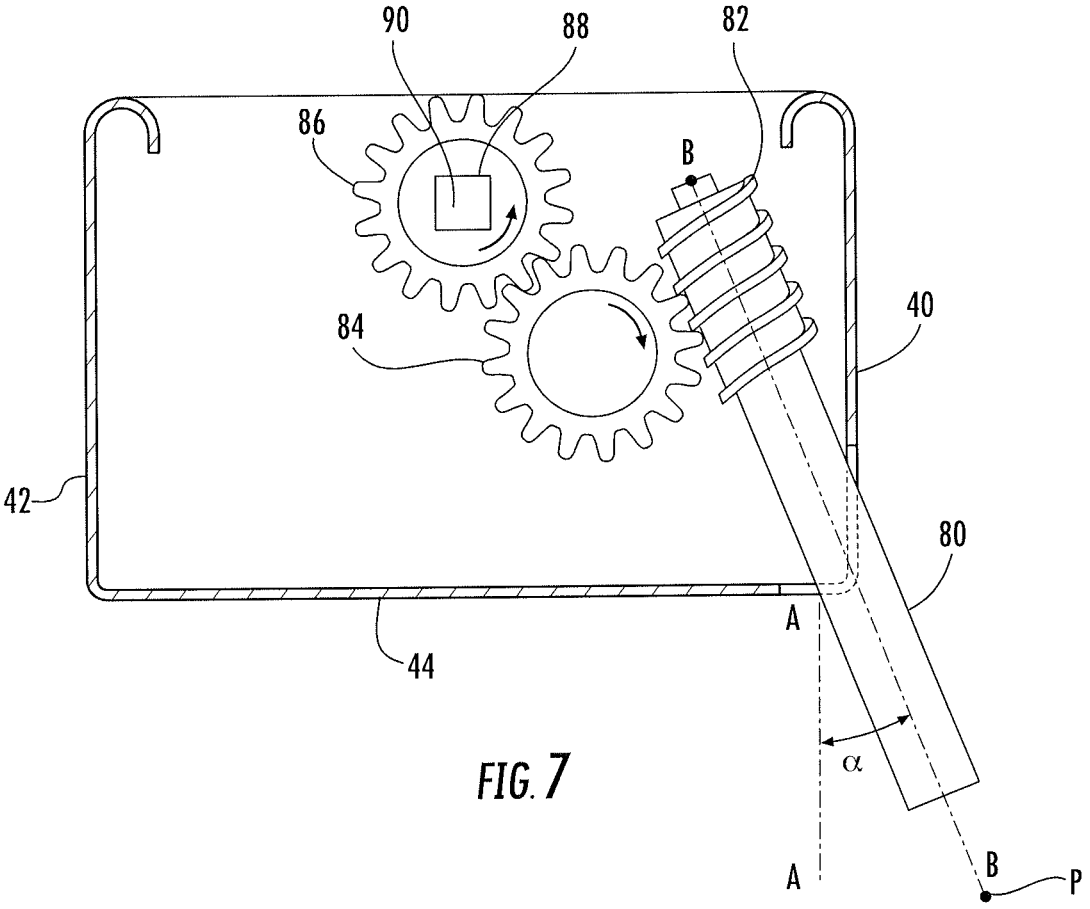
FIG. 7 is a schematic view of the tilter assembly of the invention in a head rail.

FIG. 7 shows a schematic view of an example geared configuration as may be included within a tilter assembly 70 according to example embodiments described herein. As is shown, the wand connector 80 extends at an angle from the head rail 18 such that it extends away from a front plane A-A defined by the front edges of the blind slats 17 when the slats are in the fully open position (see also FIG. 2). The front of the blind as used herein means the side of the blind having the user control and typically faces the interior of a room during normal use of the blind. The wand connector 80 extends a sufficient linear distance from the head rail 18 that the connection point P to the user control wand 25 is spaced from plane A-A and the front edges of the slats 17 such that the control wand 25 and wand connector 80 do not interfere with the slats. The angle formed between the longitudinal axis B-B of wand connector 80 may be any angle $\alpha$ that positions the wand connector and thus the control wand 25 sufficiently away from the front edges of the blind slats 17. An example preferred range for angle $\alpha$ is shown between approximately 20 degrees and approximately 35 degrees with respect to plane A-A, although other suitable angles may be used provided the wand connector does not interfere with the front edges of slats 17. In one embodiment angle $\alpha$ may be between approximately 20 degrees and 45 degrees. In other embodiments the angle $\alpha$ may be less than approximately 20 degrees provided that the wand connector extends in such a manner that the wand and wand connector do not interfere with the slats. In some embodiments the position of the wand connector 80 may be expressed as a distance L from the plane A-A. For example, in some embodiments the connection point P is disposed a distance L between approximately 0.25- and approximately 0.5 inches from the plane A-A. In some embodiments the distance may be less than 0.25 inches or greater than 0.5 inches depending on the width of the slats, valance dimensions and the angle. Angling the wand connector 80 allows the connection point P to be moved away from plane A-A a suitable distance. A control wand 25 may be connected to the distal end of the wand connector 80 at connection point P where the control wand 25 is suspended vertically and is spaced from the slats as shown, for example, in FIG. 2. In a typical window covering, valances may be used that clip onto the front of the head rail and the wand connector 80 is arranged to pass between the top slat and the valance and/or head rail without interference with any of these components. The angle $\alpha$ and the distance L are dictated by both slat width and the valance dimensions so that the angle and distance may vary from the stated ranges based on the width of slat, valance height, and the distance the valance is positioned from the front of the head rail when installed.

Rotation of the control wand 25 rotates the wand connector 80 about is longitudinal axis. In some embodiments the control wand 25 and wand connector 80 may comprise separate components as shown; however, in some embodiments these elements may be a single component. The term "wand shaft" as used herein means the wand connector 80 or other similar element that interfaces with the tilter assembly and the user control wand 25 whether formed of a single component or formed of multiple components. At the proximal end of the wand connector 80 is a worm gear 82 which is coupled to the wand connector 80 such that the wand connector 80 and worm gear 82 rotate together. The worm gear 82 operably meshes with an idler gear 84 which in turn operably meshes with a drive gear 86. A non-limiting example of gear ratios between the worm gear 80 and the drive gear 86 may be in the range of between approximately 5:1 to approximately 15:1. The drive gear 86 may typically include an aperture 88 having a particular geometry (e.g., square or hex, etc.) to interface with a tilt shaft 90 (FIG. 1) having a mating external geometry to form a keyed connection such that the shaft 90 is constrained to rotate with drive gear 86. While an embodiment of a keyed connection is shown other mechanical or frictional connections may be used to provide the coupled rotation of drive gear 86 and shaft 90.

Thus, when the control wand 25 is rotated the gearing assembly drives the drive gear 86 which in turn rotates tilt shaft 90. For example, clockwise rotation of the wand 25 may cause counter-clockwise rotation of the drive gear 86 and tilt shaft 90 (and vice versa). The tilt shaft 90 traverses at least a partial length of the head rail 18 and operatively engages a tilt drum or a plurality of tilt drums 29 as shown in FIG. 1. The tilt drums 29 may typically include an aperture 92 having a particular geometry (e.g., square or hex, etc.) to interface with tilt shaft 90 (FIG. 1) in a keyed connection such that the shaft 90 is constrained to rotate with tilt drums 29. While an embodiment of a keyed connection is shown other mechanical or frictional connections may be provided to provide the coupled rotation of drums 29 and shaft 90. The tilt shaft 90 and/or drums 29 may be supported on bearing surfaces 94 in the head rail 18 such that the shaft 90 is supported along its length and is free to rotate. Tilt drums 29 typically interface with the ladder cords 20 which support each slat 17 along the height of the blind as previously described. When the tilt shaft 90 is rotated, the tilt drums 29 rotate and cause one vertical cord of the tilt ladder cords to be raised or retracted and the other vertical cord to be lowered or extended in a reciprocal fashion. This reciprocating movement of the ladder cords causes the individual rungs 26 extending therebetween to pivot at an angle to angularly pivoting of each of the blind slats 17 to open, closed or intermediate positions.

Accordingly, the gearing, as shown in FIG. 7, permits the desired operating angle of the wand connector 80 to be achieved within the physical constraints of the head rail 18. Moreover, by using the gearing to locate the drive gear 64 in the uppermost portion of the head rail 18 the tilt shaft 90 is also positioned in the uppermost portion of the head rail 18 to permit additional blind/operating system components, such as the blind lift system, showed schematically at 51 in FIG. 2, to be positioned below the tilt shaft 90 in the head rail between the tilt shaft 90 and the bottom wall 44. In some embodiments, the tilt shaft 90 is located in approximately the top half of the height H of the head rail and in one preferred embodiment the tilt shaft 90 is located in approximately the top 25% of the height H of the head rail. The system of the invention has particular applicability with low profile head rails where the height of the head rail is minimized and may be less than the width of the head rail. In such a system a smaller drive gear is used to drive the tilt shaft. In a space limited system such as a low profile head rail, in order to maintain the angle of the wand connector in the desired approximately 20 degree-approximately 35 degree angle the worm gear may extend out of the top of the head rail thereby defeating the low profile. Using the idler gear allows a smaller drive gear to be used that may be positioned near the top of the head rail while allowing the worm gear to be completely located in the head rail and maintaining the wand connector at the desired approximately 20 degree to approximately 35 degree angle. The worm gear 82 is positioned most proximate the front wall 40 relative to the idler gear 84 and the drive gear 86 and the idler gear 84 is positioned second most proximate the front wall 40 relative to the drive gear 86 and the worm gear 82. The distance between the bottom wall 44 and the axis or rotation of the drive gear 86 is greater than the distance between the bottom wall 44 and the axis of rotation of the idler gear 84. The wand shaft 80 exits the head rail 18 adjacent the front wall 40 and the axis of rotation of the drive gear 86 is located midway between the front wall 40 and the back wall 42. The wand shaft 80 exits the head rail 18 at a point adjacent the intersection of the bottom wall 44 and the front wall 40 where the axis of rotation of the wand shaft 80 is disposed such that the axis of rotation of the idler gear 84 is positioned between the worm gear 82 and the back wall 42 and the axis of rotation of the drive gear 86 is positioned between the axis of rotation of the idler gear 84 and the back wall 42.

In other embodiments, a fewer or greater numbers of gears in the gearing assembly may be included. For example, in one embodiment, one or more additional interim gears (e.g., idler gears) may be included to alter the position of the worm gear and/or the drive gear relative to the head rail interior. Different gearing ratios may be also be achieved between the worm gear and the drive gear through the addition or subtraction of gears or by changing the gear ratios of the gears.

Figure 11:
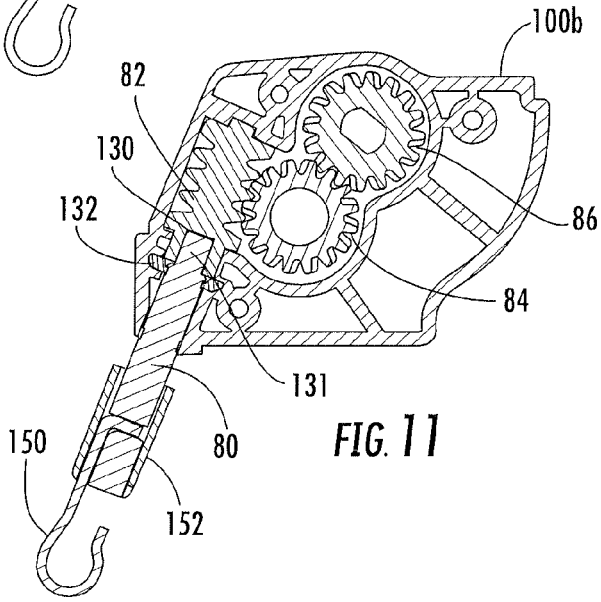
FIG. 11 is a section view of the tilter assembly taken along line 11-11 of FIG. 9.
Figure 12:
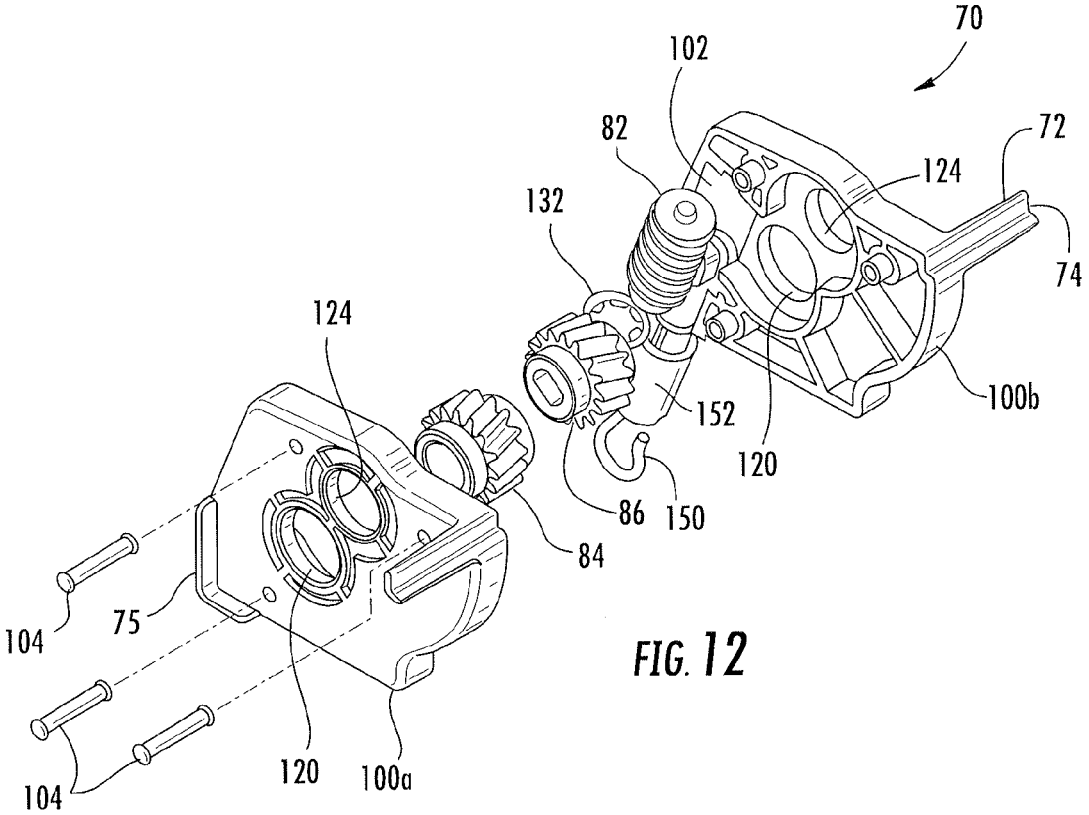
FIG. 12 is an exploded view of the tilter assembly of FIG. 8.
Figure 13:
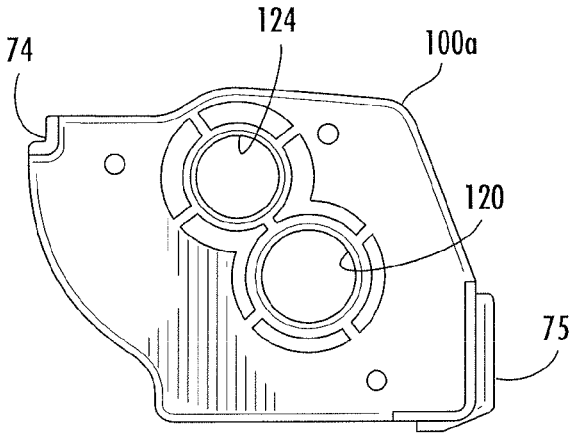
FIG. 13 is an outside side view of a casing portion for the tilter assembly of the invention.
Figure 14:
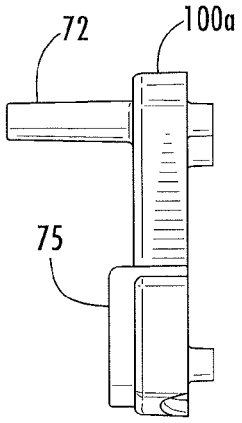
FIG. 14 is a front view of the casing portion of FIG. 13.
Figure 15:
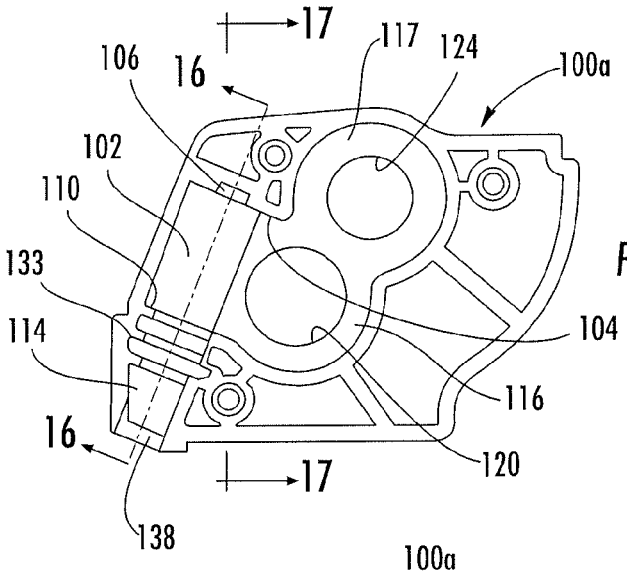
FIG. 15 is an inside side view of the casing portion of FIG. 13.
Figure 16:
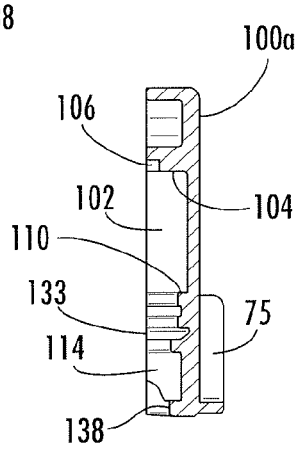
FIG. 16 is a section view of the casing portion taken along line 16-16 of FIG. 15.
Figure 17:
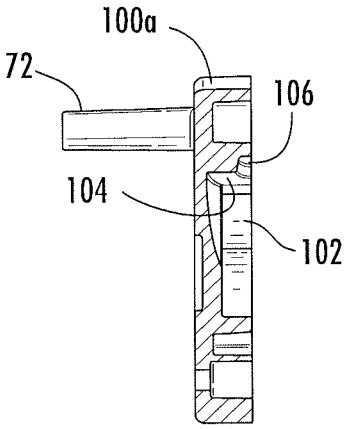
FIG. 17 is a section view of the casing portion taken along line 17-17 of FIG. 15.
Figure 18:
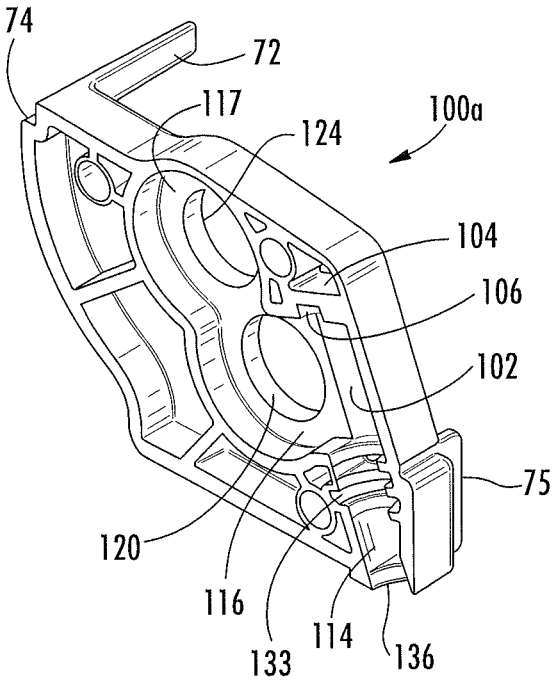
FIG. 18 is a perspective view of the casing portion of FIG. 13.

It should be appreciated that FIG. 7 shows only the internal components and operable relationships of a tilter assembly according to one embodiment of the invention. These components may be retained within a casing, such as a plastic or metal casing, which is secured within the head rail according to any number of known methods. An embodiment of a complete tilter assembly is shown in FIGS. 8-12. The tilter assembly 70 comprises the worm gear 82, idler gear 84 and drive gear 86 similar to that described with respect to FIG. 7. These elements may be contained in a housing or casing 100. The wand connector 80 may form a permanent part of the tilter assembly or it may be a separate component that is releasably coupled to the tilter assembly as will be described. The housing or casing 100 may be snap-fit into a head rail 18 with the wand connector 80 extending through aperture 50 in the housing as previously described. As shown in FIG. 12, in one example embodiment the casing 100 consists of two portions 100*a* and 100*b* defining an internal space with the gearing contained therein and the wand connector 80 extending partially therein. The casing portions 100*a* and 100*b* may be fastened or otherwise mated together, such as by fasteners 104 such a rivets or screws, or by other mechanisms such as adhesive, welding, snap-fit connectors, friction fit, and/or other mechanisms.

Figure 25:
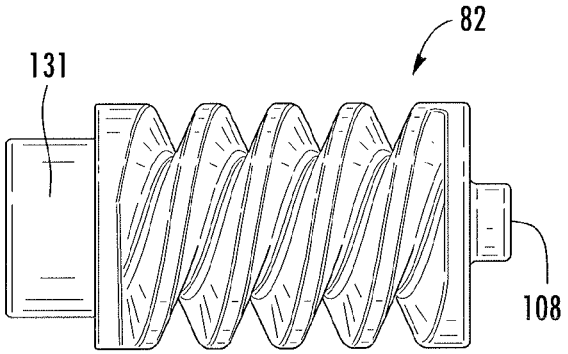
FIG. 25 is a side view of an embodiment of a worm gear usable in the tilter assembly of the invention.
Figure 26:
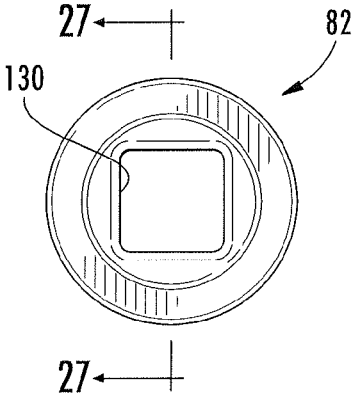
FIG. 26 is an end view of the worm gear of FIG. 25.
Figure 27:
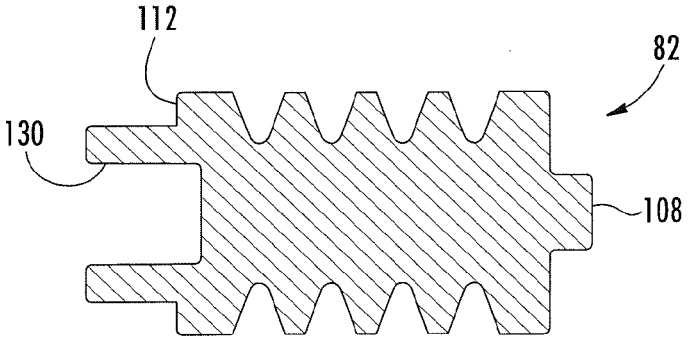
FIG. 27 is a section view of the worm gear taken along line 27-27 of FIG. 26.
Figure 28:
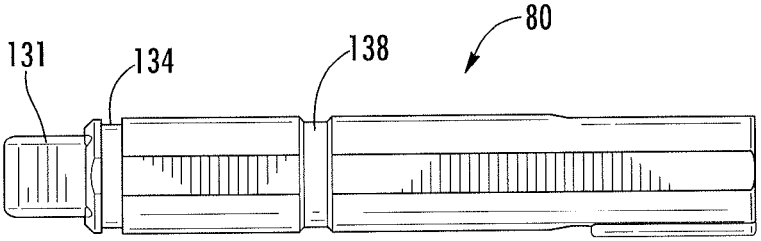
FIG. 28 is a side view of an embodiment of a wand connector usable in the tilter assembly of the invention.
Figure 29:
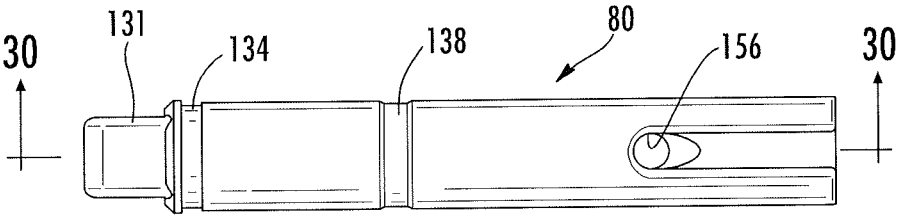
FIG. 29 is a top view of the wand connector of FIG. 28.
Figure 30:
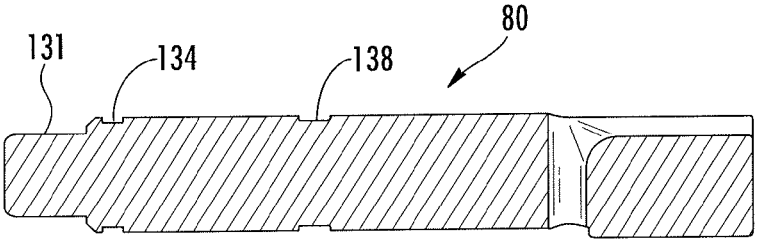
FIG. 30 is a section view of the wand connector taken along line 30-30 of FIG. 29.
Figure 31:
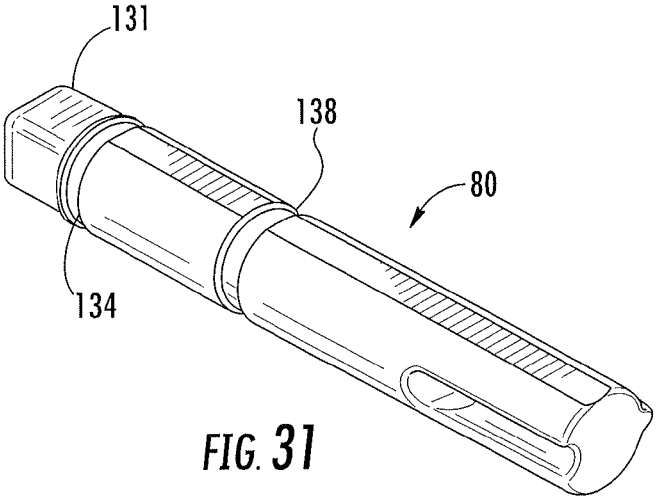
FIG. 31 is a perspective view of the wand connector of FIG. 28.

Referring to FIGS. 13-18, each casing portion 100*a*, 100*b* may be substantially identical mirror images of one another. Each casing portion defines a retainer 102 that retains the worm gear 82 such that the worm gear is free to rotate in the casing but is otherwise constrained from movement. The retainer 102 may be partially formed by a wall 104 that includes an aperture 106 for receiving an axle 108 formed in a first end of the worm gear 82 (FIGS. 25-27) that serves to at least partially secure the worm gear/wand connector in position while still permitting rotational movement within the housing. A wall 110 engages a surface 112 formed in the opposite end of worm gear 82 to trap the worm gear in the retainer 102. When the casing portions 100*a*, 100*b* are connected the retainers 102 combine to create a cavity in which the worm gear 82 rotates. Other mechanisms for supporting the worm gear may also be used. The wand connector 80 is operatively connected to the worm gear 82 such that the wand connector 80 and worm gear 82 rotate together. The wand connector 80 is supported for rotation in a semi-cylindrical retainer 114 where when the casing portions 100*a*, 100*b* are connected the semi-cylindrical retainers 114 combine to create a cylindrical cavity in which the wand connector rotates.

Figure 19:
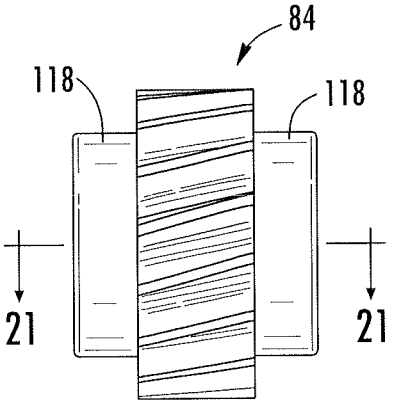
FIG. 19 is a side view of an embodiment of an idler gear usable in the tilter assembly of the invention.
Figure 20:
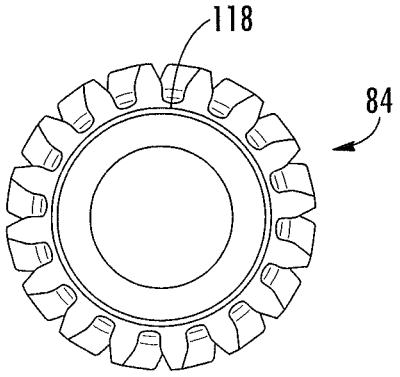
FIG. 20 is an end view of the idler gear of FIG. 19.
Figure 21:
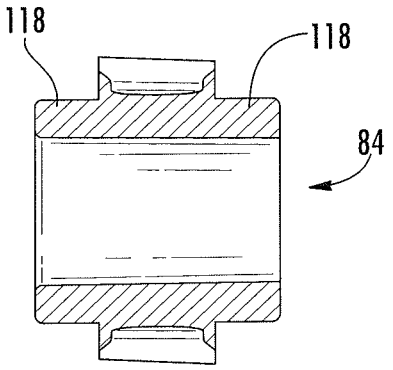
FIG. 21 is a section view of the idler gear taken along line 21-21 of FIG. 19.
Figure 22:
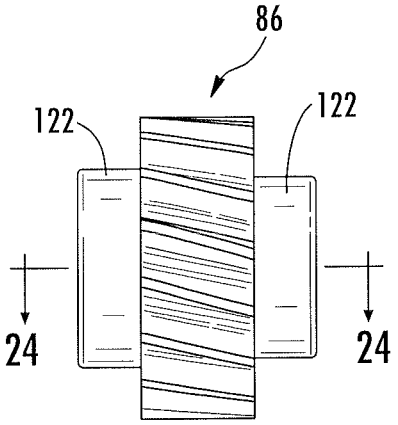
FIG. 22 is a side view of an embodiment of a drive gear usable in the tilter assembly of the invention.
Figure 23:
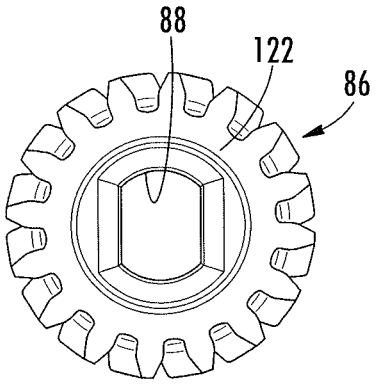
FIG. 23 is an end view of the drive gear of FIG. 22.
Figure 24:
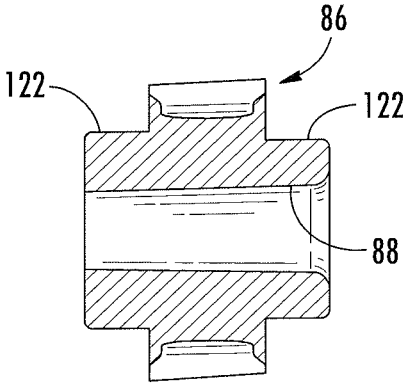
FIG. 24 is a section view of the drive gear taken along line 24-24 of FIG. 22.

The worm gear 82 communicates with an idler gear chamber 116 such that an idler gear 84 supported between the casing portions 100*a*, 100*b* may mesh with the worm gear 82. In one embodiment the idler gear 84 includes cylindrical bearing surfaces 118 (FIGS. 19-21) that define the axis of rotation of the idler gear 84 and are rotatably supported in apertures 120 formed in the casing portions 110*a*, 110*b*. The idler gear 84 communicates with a drive gear chamber 117 such that the drive gear 86, supported between the casing portions 100*a*, 100*b*, may mesh with the idler gear 84. In one embodiment the drive gear 86 includes cylindrical bearing surfaces 122 (FIGS. 22-24) that define the axis of rotation of the drive gear and are rotatably supported in apertures 124 formed in the casing portions 100*a*, 100*b*. The internal keyed hole 88 of the drive gear 86 may be accessed from the exterior of the casing 100 via aperture 124 such that the tilt shaft 90 may be inserted into the aperture 88. Aperture 88 may have a narrowing tapered shape such that the tilt shaft 90 may be forced into the aperture and be retained by a friction/compression fit.

Figure 32:
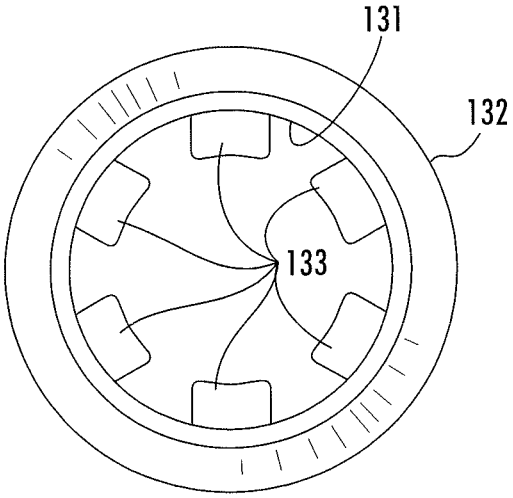
FIG. 32 is a top view of an embodiment of a locking member usable in the tilter assembly of the invention.

In one embodiment, a keyed connection defined by a cylindrical bearing surface 131 and an internal recess 130 is formed at the distal end of the worm gear 82. The recess 130 receives the proximate end 131 of the wand connector 80 as shown in FIG. 11. According to one embodiment, this recess 130 may have a particular keyed geometry (such as a square, hexagonal or other shaped perimeter) that mates with complementary external geometry on the proximate end 131 of the wand shaft extender and permits both to be rotated together. Note the worm gear 82 may comprise the external geometry and the wand connector 80 may comprise the mating recess. A locking member 132 is positioned within a comparably sized cavity 133 within the housing 100 at a distal end of the worm gear 82 beneath the worm gear teeth. The locking member 132 is positioned within cavity 133 such that it can engage a detent such as groove 134 on wand connector 80. The groove 134 may be positioned between end 131 of the wand extender 80 and the remainder of the wand extender. The engagement of the locking member 132 with groove 134 retains the wand connector 80 within the worm gear 82 and within the housing 100. The wand connector 80 is inserted into the casing 100 via aperture 136 such that the keyed end 131 is inserted past the locking member 132 and the groove 134 is engaged by the locking member 132. In one embodiment the locking member 132 is deformable such that as the wand connector 80 is inserted into the worm gear 82 the locking member 132 is deformed and resiliently engages groove 134 in a snap-fit connection where the linear motion of the wand connector into the tilter assembly locks the wand connector to the tilter assembly and operatively couples the wand connector 80 to the worm gear 82 without additional assembly steps, parts or tools. In one embodiment the locking member comprises a locking washer as shown in FIG. 32 having a central hole 131 that includes a plurality of inwardly directed teeth 133 (FIG. 32). The wand connector 80 is inserted through hole 131 and the groove 134 is engaged by the teeth 133 during assembly of the wand connector 80 to the tilter assembly. While the locking member is disclosed as a locking washer the locking member may comprise any tang and detent locking device that allows the wand connector 80 to be inserted into the tilter assembly and locked to the worm gear 82.

Accordingly, in an embodiment such as this, the wand connector 80 can be shipped unassembled, to prevent damage to the blind components and the extender and to reduce packaging size. During installation of a blind, a user inserts the keyed end 131 of the wand connector 80 into the aperture 136, forcing the keyed end 131 into the recess 130 of the worm gear 82 (preassembled in the housing) and the locking member 132 (also preassembled in the housing) into the groove 134 of the wand connector 80. In the embodiment shown in the figures, the locking member 132 may be positioned with the inner teeth 133 angled upwards toward the worm gear 82, which permits easier insertion of the wand connector 80 through the locking member but more difficult removal of the keyed end 131 of the wand connector from the locking member to provide a secure engagement between the wand connector 80 and the worm gear 82. The wand connector 80 may be formed with a groove 138 that receives the edge of aperture 136. Other means for securing the wand connector to the worm gear may be utilized. Moreover, according to other embodiments, the worm gear 82 and wand connector 80 may be formed as a single piece or may not be constructed for selective engagement and release, such as in embodiments that are assembled, packaged, and shipped with the wand shaft extender 80 already affixed to the worm gear and positioned within the housing, not requiring consumer assembly.

Figure 33:
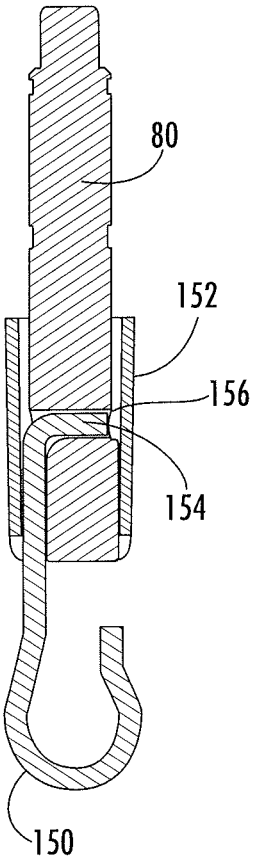
FIG. 33 is a section view of an embodiment of the wand connector, hook and sleeve usable in the tilter assembly of the invention.

Referring to FIG. 33, an example connection mechanism for securing the wand hook 150 (to which the wand 25 connects via an eyelet 151) to the distal end of the wand connector 80 is shown. According to this example, a retainer sleeve 152 is slidably mounted on wand connector 80 such that it may be slid over the proximal end of the hook 150. The proximal end of hook 150 comprises an arm 154 that is positioned in a hole 156 formed at least partially through the wand connector 80 near the distal end of wand connector 80. After the arm 154 is positioned in the hole 156 the sleeve 152 is slid over the end of the hook 150 to retain the hook on the wand extender 80. It is appreciated that there are numerous other means for securing a wand hook to the wand shaft extender, and the embodiments described herein shall not be so limited to that shown and described with reference to these figures. Moreover, it is also appreciated that a number of other mechanisms for connecting a tilt wand to the wand shaft extender may exist, and that any of those mechanisms may likewise be incorporated with the embodiments described herein.

Figure 34:
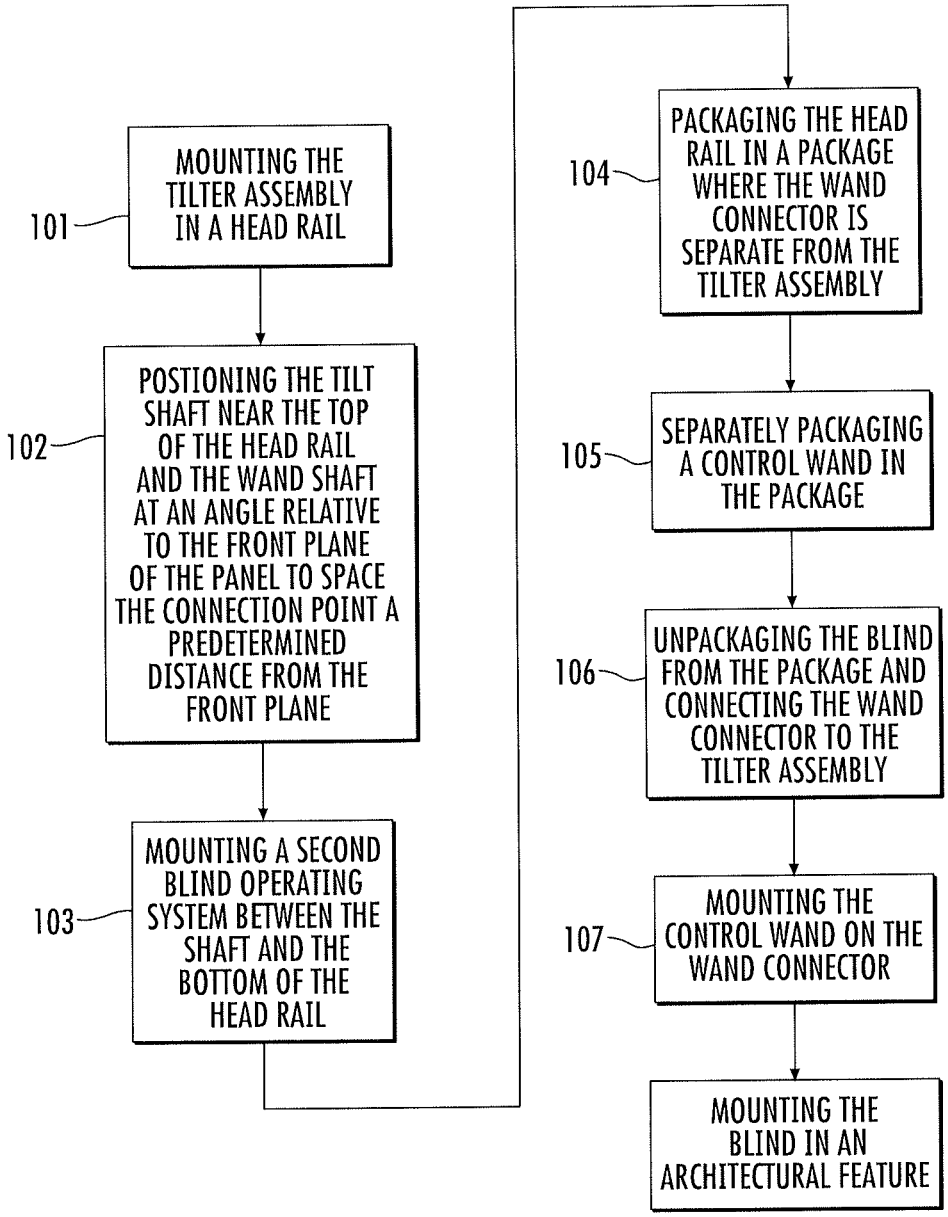
FIG. 34 is a block diagram illustrating a method of operation of the window covering.

In one embodiment of a method of making and using the window covering is provided. The tilter assembly as described herein is mounted in a head rail (FIG. 34, Block 101). The tilter assembly is arranged such that the tilt shaft is positioned near the top of the head rail and the wand shaft is disposed at an angle relative to the front plane of the panel to space the connection point a predetermined distance from the front plane (Block 102). Another blind operating system component such as a lift system is mounted in the head rail between the shaft and the bottom wall of the head rail (Block 103). The second operating system component such as the slat lift system may be mounted in the head rail prior to mounting the tilter assembly in the head rail. The blind including the head rail is packaged in a package where the wand connector is separate from the tilter assembly such that the wand connector does not protrude beyond the profile of the packaged window covering (Block 104). A separate control wand is also packaged in the package (Block 105). For example, in one embodiment the wand connector and/or the control wand may be stored inside of the head rail for packaging purposes. The control wand is releasably engageable with the wand connector and the wand connector is releasably engageable with tilter assembly. As previously explained the wand connector and control wand may comprise a single component. The blind is unpackaged from the package and the wand connector is inserted into the tilter assembly to create a snap-fit connection between the wand connector and the tilter assembly (Block 106). The control wand may then be mounted on the wand connector (Block 107). The blind may be mounted to an architectural feature such as a window (Block 108). Note, the wand connector may be coupled to the tilter assembly either before or after the blind is mounted on the architectural feature.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A window covering comprising:

a head rail comprising a front wall, a bottom wall, a back wall, and an aperture comprising a first portion defined in the bottom wall and a second portion defined in the front wall;

a plurality of slats suspended from the head rail below the bottom wall and supported for a tilting motion, each of the slats comprising a slat edge, the slat edges defining a plane extending through the slat edges; and a tilter assembly operatively connected to the slats for tilting the slats, the tilter assembly comprising:

a worm gear;

a wand shaft operatively connected to the worm gear and having a first axis of rotation, the first axis of rotation extending at a fixed angle relative to the plane, and the wand shaft extending through the aperture of the head rail;

a tilt shaft;

a drive gear operatively connected to the tilt shaft and having a second axis of rotation, the second axis of rotation spaced a first distance from the bottom wall; and an idler gear connecting the worm gear to the drive gear and having a third axis of rotation, the third axis of rotation spaced a second distance from the bottom wall;

wherein the first distance is greater than the second distance; and wherein rotation of the wand shaft rotates the worm gear which rotates the idler gear which rotates the drive gear which rotates the tilt shaft and causes the tilting motion of the slats.

2. The window covering of claim 1, wherein the fixed angle of the first axis of rotation relative to the plane is an acute angle of at least 20 degrees.

3. The window covering of claim 1, wherein the fixed angle of the first axis of rotation relative to the plane is in the range between 20 degrees and 35 degrees.

4. The window covering of claim 1, wherein a gear ratio between the worm gear and the drive gear is in the range between 5:1 and 15:1.

5. The window covering of claim 1, wherein the drive gear comprises an aperture that receives the tilt shaft.

6. The window covering of claim 1, wherein the head rail has a height, and wherein the tilt shaft is located in the top 25% of the height of the head rail.

7. The window covering of claim 1, wherein the worm gear is positioned between the idler gear and the front wall, wherein the idler gear is positioned between the drive gear and the worm gear, and wherein the drive gear is positioned between the back wall and the idler gear.

8. The window covering of claim 1, wherein the first portion of the aperture of the head rail is smaller than the second portion of the aperture of the head rail.

9. The window covering of claim 1, wherein the wand shaft exits the head rail at a point adjacent an intersection of the bottom wall and the front wall, wherein the third axis of rotation is positioned between the worm gear and the back wall, and wherein the second axis of rotation is positioned between the third axis of rotation and the back wall.

10. The window covering of claim 1, wherein the wand shaft comprises a wand connector coupled to the worm gear.

11. The window covering of claim 10, wherein the tilter assembly further comprises a control wand connected to the wand connector at a connection point, wherein the connection point is spaced from the plane at least 0.25 inches.

12. The window covering of claim 1, wherein the tilter assembly further comprises a tilt drum supported by the tilt shaft and connected to the slats by a tilt cord.

13. The window covering of claim 12, wherein the tilt drum comprises a keyed aperture that receives the tilt shaft.

14. The window covering of claim 1, wherein the second axis of rotation is positioned midway between the front wall and the back wall.

15. The window covering of claim 14, wherein the tilt shaft is positioned in an upper half of the head rail.

16. A window covering comprising:

a head rail;

a plurality of slats defining a front plane; and a tilter assembly supported by the head rail and operatively connected to the slats for tilting the slats, the tilter assembly comprising:

a tilt shaft;

a drive gear coupled to the tilt shaft;

a casing;

a worm gear operatively coupled to the drive gear and positioned in the casing;

a wand shaft for rotating the drive gear, the wand shaft comprising a first end that is insertable through the casing and releasably engages the worm gear such that the wand shaft and the worm gear rotate together; and a locking member separate from the worm gear and the wand shaft for retaining the first end of the wand shaft in the casing, wherein the locking member is deformable to engage the wand shaft, and wherein the locking member is retained in the casing such that the wand shaft rotates relative to the locking member.

17. The window covering of claim 16, wherein the tilter assembly further comprises an idler gear connecting the worm gear and the drive gear, and wherein the idler gear, the worm gear, and the drive gear are retained in the casing.

18. The window covering of claim 16, wherein the casing is snap-fit into the head rail.

19. The window covering of claim 16, wherein the head rail comprises an aperture defined at least partially in a front wall of the head rail, and wherein the wand shaft extends at least partially through the aperture.

20. The window covering of claim 16, wherein the worm gear comprises a keyed recess, and wherein the first end of the wand shaft is removably received within the keyed recess.

21. The window covering of claim 16, wherein the wand shaft comprises a wand connector that releasably engages the worm gear and defines a connection point, and a control wand connected to the wand connector at the connection point.

22. The window covering of claim 21, wherein the wand connector is disposed at an angle of at least 20 degrees relative to the front plane.

23. The window covering of claim 16, wherein the locking member comprises a washer defining a central hole for receiving the wand shaft.

24. The window covering of claim 23, wherein the washer comprises a plurality of teeth extending into the central hole for engaging the wand shaft.

25. A tilter assembly for a window covering having a head rail and a plurality of slats supported for tilting motion and defining a front plane, the tilter assembly comprising:

a worm gear;

a wand connector comprising a first end that releasably engages the worm gear such that the wand connector and the worm gear rotate together, and a connection point opposite the worm gear for receiving a control wand, wherein the wand connector has an axis of rotation extending at a fixed angle relative to the front plane;

a locking member separate from the worm gear and the wand connector for retaining the first end of the wand connector in engagement with the worm gear, wherein the locking member is deformable to engage the wand connector, and wherein the locking member engages the wand connector such that the wand connector rotates relative to the locking member;

a tilt shaft;

a drive gear operatively connected to the tilt shaft; and an idler gear in operable communication with the worm gear and the drive gear such that rotation of the wand connector causes a tilting motion of the slats.

26. The tilter assembly of claim 25, wherein the locking member comprises a washer defining a central hole for receiving the wand connector.

27. The tilter assembly of claim 26, wherein the washer comprises a plurality of teeth extending into the central hole for engaging the wand connector.

* * * * *